US006932055B2

(12) United States Patent
Rado

(10) Patent No.: US 6,932,055 B2
(45) Date of Patent: Aug. 23, 2005

(54) ENGINE CONTROL SYSTEM FOR INTERNAL COMBUSTION ENGINES

(75) Inventor: Gordon E. Rado, Plymouth, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/674,970

(22) Filed: Sep. 30, 2003

(65) Prior Publication Data

US 2004/0123837 A1 Jul. 1, 2004

Related U.S. Application Data

(60) Provisional application No. 60/448,263, filed on Feb. 17, 2003, and provisional application No. 60/416,859, filed on Oct. 8, 2002.

(51) Int. Cl.[7] ..... F02D 41/14; F02D 43/04

(52) U.S. Cl. ..... 123/352; 123/361; 123/458; 123/497; 123/676

(58) Field of Search ..... 123/350–357, 123/361, 363, 376, 458, 497, 676

(56) References Cited

U.S. PATENT DOCUMENTS 2,883,975 A * 4/1959 Spetner ..... 123/352
2,971,596 A * 2/1961 Davis et al. ..... 123/352
4,409,940 A 10/1983 Gaus ..... 123/361
4,422,420 A * 12/1983 Cromas et al. ..... 123/352
4,430,975 A 2/1984 Ishida et al. ..... 123/399
4,867,261 A 9/1989 King ..... 180/179
4,884,541 A 12/1989 Marriott ..... 123/361
4,887,684 A 12/1989 King ..... 180/179
5,103,125 A 4/1992 Ogden ..... 310/72
5,141,070 A 8/1992 Hickmann et al. ..... 180/197
5,558,062 A * 9/1996 De Minco et al. ..... 123/361
5,672,818 A 9/1997 Schaefer et al. ..... 73/118.2
5,901,683 A * 5/1999 Patel ..... 123/352

* cited by examiner

*Primary Examiner*—Tony M. Argenbright
(74) *Attorney, Agent, or Firm*—Baker & Daniels

(57) ABSTRACT

An engine control system for maintaining the operator-commanded speed setting of an internal combustion engine over a range of engine loads and for easy starting and improved efficiency over a range of ambient and engine operating temperatures. The engine control system includes a governor assembly driven by the engine, the governor assembly supplying an output to a sensor assembly through a mechanical coupling member operator. The sensor assembly provides an engine speed control signal which corresponds to operator commanded engine speed and actual engine speed. The engine speed control signal is provided to a throttle actuator to control actual engine speed is controlled to correspond with the operator-commanded engine speed regardless of loads imposed on the engine.

37 Claims, 15 Drawing Sheets

ENGINE CONTROL SYSTEM FOR INTERNAL COMBUSTION ENGINES

This application claims the benefit of U.S. Provisional Application No. 60/416,859 filed Oct. 8, 2002 and claims the benefit of U.S. Provisional Application No. 60/448,263 filed Feb. 17, 2003.

BACKGROUND OF THE INVENTION

1. Field of the Invention

The present invention relates to engine control for internal combustion engines and, more particularly, for small internal combustion engines of the type which are used in a variety of applications, such as walk-behind lawnmowers, lawn and garden implements, generators, or in small utility vehicles such as riding lawnmowers, lawn tractors, and the like.

2. Description of the Related Art

Small internal combustion engines generally include an operator-selected command speed setting, for example, a throttle control for utility vehicles or a normal/idle switch for generators. However, driving a variable load may reduce or increase the engine speed from the commanded setting. For example, in a lawnmower powered by an internal combustion engine, it is desired that the commanded speed of the engine remain relatively constant under a variety of loading conditions. Thus, it is desired that whether the lawnmower encounters tall grass or short grass, the engine speed which has been selected by the operator should remain constant. Likewise, in the case of a generator, it is desired that the alternator output frequency, i.e., the engine drive speed, remain constant despite changes in the electrical loads connected to the alternator output.

To regulate engine speed, small internal combustion engines generally include a mechanical speed-regulating governor, such as an air vane mechanism or a centrifugal flyweight mechanism sensitive to engine speed. For engines having a carburetor, the throttle valve is generally mechanically linked to both the governor and the operator throttle control. Therefore, the throttle valve is acted upon by a first force related to the commanded speed setting and a second force corresponding to the governor and related to the actual engine speed.

A disadvantage of known engine control systems for small internal combustion engines is the potential unreliability of cables, springs, and linkages that are used to transmit and combine the inputs from the operator-commanded engine speed and the actual engine speed. Such components might bind, require lubrication, or may fail from mechanical vibrations or loading.

Another disadvantage of known engine control systems for small internal combustion engines is the difficulty of mechanically adjusting the amount of movement of the throttle valve as it relates to the commanded engine speed setting or the actual engine speed and the difficulty of providing dampening of transients due to engine speed changes.

Yet another disadvantage of known speed control mechanisms for small internal combustion engines is that ambient temperature and engine operating conditions are not taken into account to adjust the fuel-to-air ratio for easy starting and optimum efficiency for a range of ambient engine conditions.

What is needed is an engine control system for internal combustion engines that reliably accounts for the commanded engine speed setting and the actual engine speed to drive the throttle and fuel controls, and that accounts for the ambient and engine operating temperatures to provide an efficient fuel-to-air ratio.

BRIEF SUMMARY OF THE INVENTION

The present invention is directed to an engine control system for an internal combustion engine. The engine control system may include a governor assembly, engine speed sensor, control circuit, and fuel system. The governor assembly and sensor are coupled by a coupling member. The coupling member is displaced relative to the governor assembly according to the engine speed. The sensor detects the displacement of the coupling member and outputs an electrical speed signal related to the actual engine speed.

A first and second exemplary engine control system includes a control circuit that provides a speed command signal to control the intake system of the engine, including air flow, fuel flow, and/or air-to-fuel ratio, to correlate the actual engine speed to the operator-commanded speed setting. The speed command signal is a function of both commanded speed and the actual engine speed, which may be detected by the governor assembly and sensor.

A third exemplary engine control system includes a control circuit and may also include a combination of an exhaust temperature sensor cylinder head temperature, an intake temperature sensor, and/or mass air flow for detecting ambient and engine operating conditions. The output of the sensors is used to control one or both of a throttle signal and a fuel flow signal for adjusting the fuel-to-air ratio for a more efficient engine start and efficiency over a range of operating conditions.

The control systems may also include elements of a fuel system. For a first exemplary fuel system, a fuel signal is supplied to control the speed of a fuel pump motor, thereby controlling the fuel flow through a fuel injector. A second exemplary fuel system provides the fuel flow signal to a solenoid which controls the fuel flow through a regulator valve, thereby controlling the fuel flow through the fuel injector.

Small internal combustion engines used in a variety of applications generally include an operator-controlled commanded speed setting. However, as the engine drives a variable load, the engine may slow from the commanded speed when the load is increased, or overshoot the commanded speed when the load is decreased. The invention provides an engine control system that provides constant engine speed under varying loads by determining engine control inputs from both the operator-commanded speed and the actual engine speed.

Advantageously, the present engine control system for internal combustion engines provides operator setting, detection, and adjustment of engine speeds using electrical components and electrical signals in the place of certain mechanical components which had typically been used in known systems. The electrical and other components of the present engine control system reliably transmit engine control signals and provide for simple adjustment of engine control and dampening of the response of the engine control system to changes in the engine speed.

Additionally, the second exemplary speed control system may provide a combination of intake air temperature sensing, intake mass airflow sensing, exhaust gas temperature sensing, and cylinder head temperature sensing to adjust the fuel flow for optimal cold start, hot start, and performance over a range of operating temperatures and other conditions.

In one form thereof, the present invention provides an engine control system for an internal combustion engine, including a governor assembly mounted to and driven by the engine and responsive to engine speed; a coupling member associated with the governor assembly, the coupling member displaceable by the governor assembly according to engine speed; and a position sensor controlled by the coupling member, the position sensor detecting the displacement of the coupling member and outputting an electrical speed signal corresponding to the displacement and to engine speed.

In another form thereof, the present invention provides an internal combustion engine, including an engine housing; an engine control device connected to the housing; a governor assembly connected to the housing and responsive to engine speed; a coupling member coupled with the governor assembly and movably displaced by the governor assembly in response to engine speed; and a position sensor mounted to the housing and detecting the position of the coupling member, the position sensor outputting an electrical speed signal, the speed signal acting upon the engine control device to adjust the engine speed.

In a further form thereof, the present invention provides an engine control system for an internal combustion engine, including a governor assembly driven by the engine, the governor assembly having a spool capable of translating axially in response to the engine speed; a rotary shaft associated with the spool such that the rotary shaft is rotationally displaced upon translation of the spool; a spring coupled between the engine and the rotary shaft, the spring resisting rotational displacement of the rotary shaft; and a rotary position sensor capable of detecting the rotational position of the rotary shaft and outputting an electrical speed signal corresponding to the position.

In another form thereof, the present invention provides a method of controlling the speed of an internal combustion engine having a mechanical governor and at least one of an intake throttle and a fuel injector, including the steps of driving the governor to produce an output proportional to engine speed; sensing the governor output; determining an actual engine speed from the governor output; supplying a commanded engine speed signal; and controlling at least one of the intake throttle and fuel injector based on the actual engine speed signal and the commanded engine speed signal.

In yet a further form thereof, the present invention provides an engine control system for a small internal combustion engine, the system including at least one of a voltage supply and a current supply, a governor sensor having an input and an output, the governor input coupled to the at least one of a voltage supply and current supply, an operator control sensor having an input and an output, the operator control sensor input coupled to the governor sensor output, and at least one of an intake throttle actuator and a fuel flow controller coupled to the operator control sensor output.

In a further form, the present invention provides an engine control system for a small internal combustion engine, the system including at least one of a voltage supply and a current supply; an operator control sensor having an input and an output, the operator control sensor input coupled with the at least one of a voltage supply and a current supply; a governor sensor having an input and an output, the governor sensor input coupled to the operator control sensor output; and at least one of an intake throttle actuator and a fuel flow controller coupled to the governor sensor output.

In yet another form, the present invention provides an engine control system for a small internal combustion engine, the system including an operator control sensor providing a command signal; an engine speed sensor providing a speed signal; a control circuit receiving the command signal and the speed signal and providing a fuel control signal; and a fuel flow device having an actuator adapted for adjusting the fuel flow through the fuel flow device, the actuator receiving the fuel control signal.

BRIEF DESCRIPTION OF THE DRAWINGS

The above-mentioned and other features and advantages of this invention, and the manner of attaining them, will become more apparent and the invention itself will be better understood by reference to the following description of exemplary embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1A:
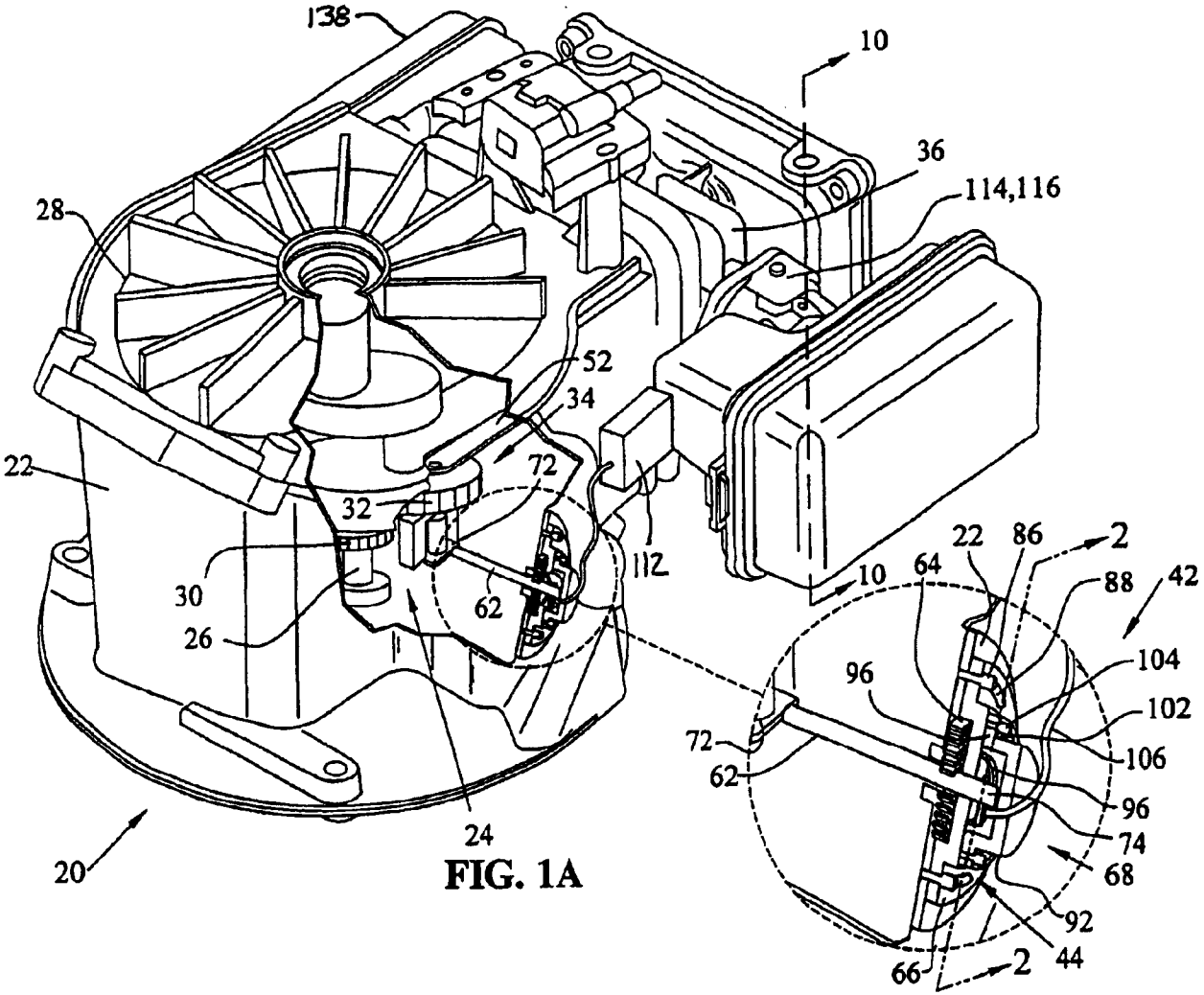
FIG. 1A is a cutaway perspective view of a small internal combustion engine having an engine speed sensor in accordance with the present invention.
Figure 1B:
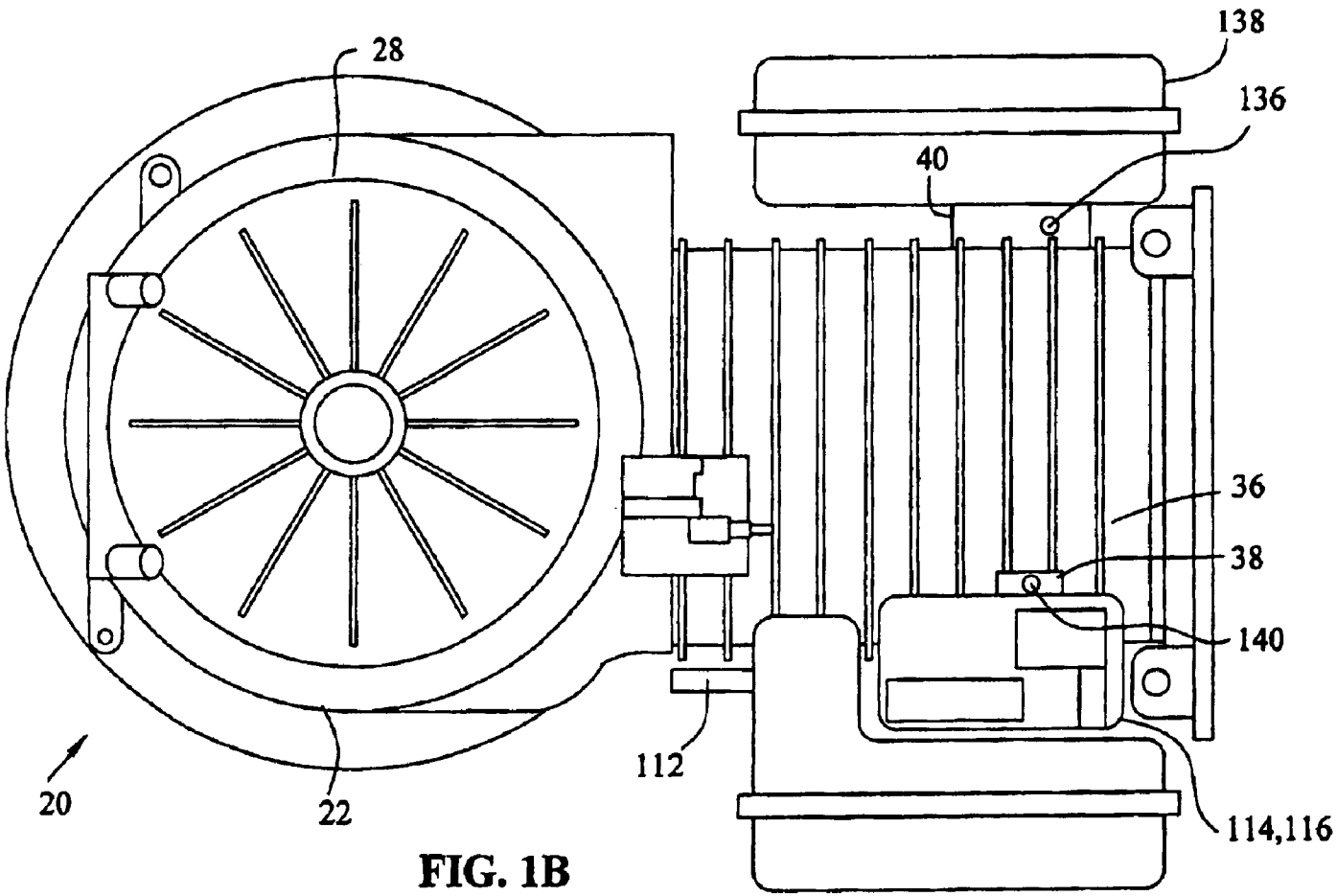
FIG. 1B is a top view of the small internal combustion engine shown in FIG. 1A.

Referring to FIG. 1A, small internal combustion engine 20 is shown, including engine housing 22 with crankcase 24, crankshaft 26 located internal to and supported by housing 22, and flywheel 28 mounted to an end of crankshaft 26 extending outside of housing 22. Crankshaft 26 is coupled to a piston (not shown) via a connecting rod (not shown), and further drives a valve train for actuating intake and exhaust valves within engine housing 22. The drive train of engine 20 may be of the overhead valve (OHV), overhead cam (OHC) L-head/side valve type, or another drive train type known in the art. Crankshaft gear 30, or another suitable drive mechanism, is mounted on crankshaft 26 for driving governor gear 32 of flyweight governor assembly 34. Flyweight governor assembly 34 may be located inside crankcase 24, and may be supported by housing 22. Referring to FIG. 1B, cylinder head 36 is supported by housing 22 and is connected to intake 38 and exhaust 40.

Referring again to FIG. 1A, engine speed sensor 42 may be supported by engine housing 22, and generally includes flyweight governor assembly 34 and sensor assembly 44. Engine speed sensor 42 may be coupled to operator throttle control 46 and provide speed control signal 48, as shown in the schematic diagram of a portion of first exemplary engine control system 50 in FIG. 3.

Figure 2:
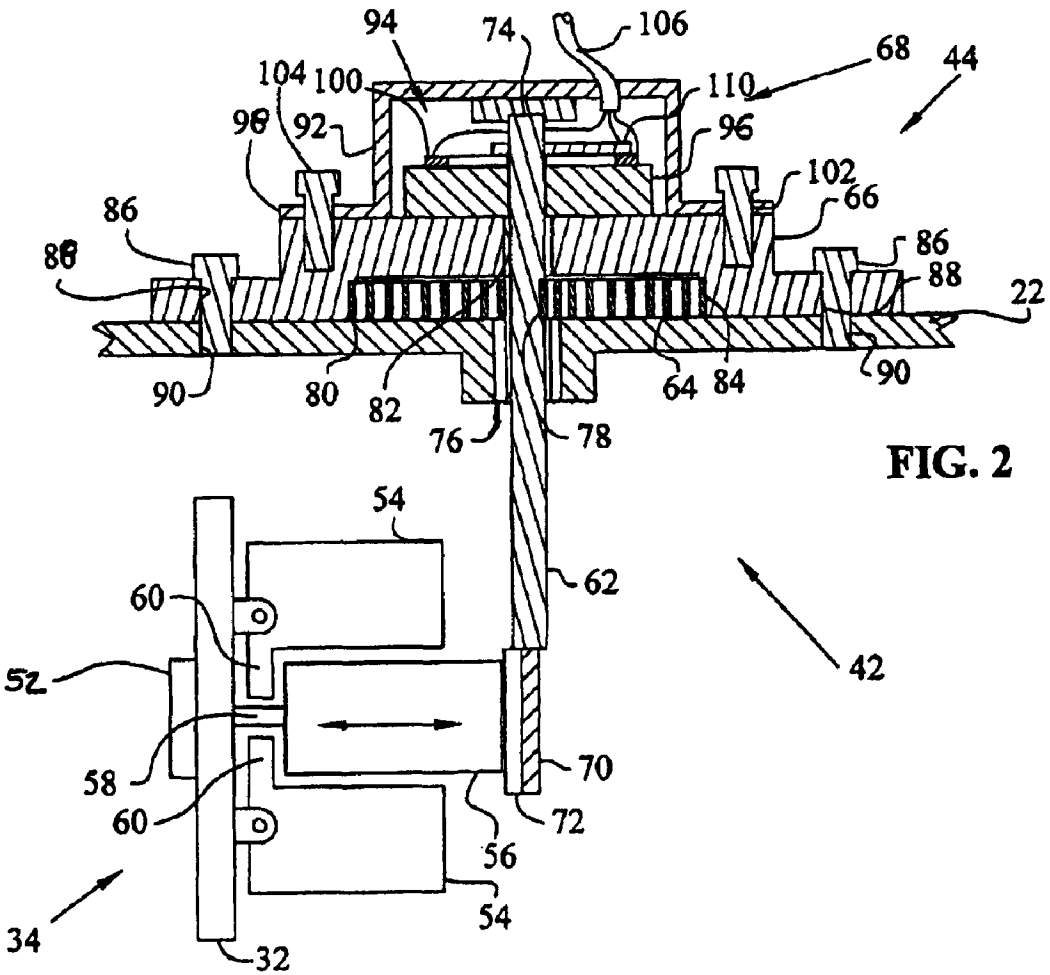
FIG. 2 is a sectional view of a portion of the engine speed sensor of FIG. 1A, taken along line 2—2 of FIG. 1.

Referring to FIG. 2, flyweight governor assembly 34 is rotatably supported on housing 22 by governor support 52, which may be a stub shaft, for example, and includes governor gear 32, flyweights 54, spool 56, and spindle 58. Governor gear 32 is engaged by crankshaft gear 30 (FIG. 1A) such that flyweight governor 34 rotates proportionally to the speed of crankshaft 24 when engine 20 is running. Weights 54 are pivotably mounted to governor gear 32. Spool 56 is slidably mounted on spindle 58 and is supported by lever portions 60 of weights 54 such that spool 56 is moveable axially on spindle 58. When governor gear 32 is driven by crankshaft gear 30 above a predetermined speed, weights 54 swing outwardly under centrifugal force, rotating weight levers 60 and pushing spool 56 axially away from governor gear 32. As the engine speed slows, weights 54 return inwardly, allowing spool 56 to axially translate toward governor gear 32.

Sensor assembly 44 generally includes rotary shaft 62, coil spring 64, spring housing 66, and rotary sensor 68. Rotary shaft 62 transmits the engine speed from flyweight governor 34 to sensor 68, and includes first end 70 having radially extending rotary lever 72, and second end 74 which extends through engine housing 22 to rotary sensor 68. Rotary shaft 62 is rotationally supported by bushing 76 within housing 22. Lever 72 is positioned in contact with spool 56 so that axial translation of spool 56 displaces lever 72 to rotate rotary shaft 62. Thus, as governor assembly 34 is driven above a predetermined speed, rotary shaft 62 and sensor 68 are rotated proportionally to the speed of engine 20.

Coil spring 64 is coupled between rotary shaft 62 and engine housing 22 and provides resistance to rotation of rotary shaft 62. Thus, as the engine speed slows and weights 54 of flyweight governor 34 pivot inwardly, allowing spool 56 to translate toward governor gear 32, coil spring 64 rotates rotary shaft 62 such that rotary lever 72 remains in operational contact with spool 56, thereby returning rotary shaft 62 to its undisplaced, low speed rotational position.

Although located external to engine housing 22 in the exemplary embodiment, coil spring 64, spring housing 66, and/or sensor 68 may alternatively be positioned within the interior of engine housing 22, and flyweight governor assembly 44 may be alternatively positioned exteriorly of engine housing 22. Additionally, although the exemplary embodiment includes rotary shaft 62 which is rotationally displaced by flyweight governor 34, other means of sensing engine speed and providing an input to sensor 68 may be used, for example, flyweight governor 20 may actuate a linear member, the position of which is sensed by a position sensor.

Referring to FIGS. 1A and 2, coil spring 64 includes interior end 78 coupled to rotary shaft 62 and exterior end 80 coupled to spring housing 66. Spring housing 66 defines bore 82 for passage of rotary shaft 62 therethrough, and recess 84 for receiving coil spring 64 between coil spring housing 66 and engine housing 22. Spring housing 66 is mounted to engine housing 22 by fasteners 86 which pass through spring housing slots 88. As shown in FIG. 1, spring housing slots 88 are arcuately shaped.

For adjustment of the rotational tension applied on rotary shaft 62 by coil spring 64, spring housing 66 may be coarsely rotationally adjusted by aligning selected slots 88 with selected mounting holes 90 defined in engine housing 22, and then inserting fasteners 86 through slots 88 into mounting holes 90. The tension of coil spring 64 may then be finely adjusted by further rotating spring housing 66 with fasteners 86 extending through arcuate slots 88, followed by tightening fasteners 86 to secure spring housing 66 relative to engine housing 22. Similarly, the tension of coil spring 64 may be adjusted after initial assembly of sensor assembly 44 by loosening fasteners 86, rotating spring housing 66 to a selected position, and re-tightening fasteners 86.

In the embodiment shown in FIGS. 1A and 2, rotary sensor 68 is a potentiometer. Rotary sensor 68 includes a cup-shaped sensor housing 92 having pocket 94 and mounting flange 98 extending around the periphery of sensor housing 92. Pocket 94 receives potentiometer disk 96 having arcuate resistor contact area 100 for producing actual speed signal 48 (FIG. 3).

Mechanical calibration adjustment of speed signal 48 may be provided by rotating sensor housing 92 relative to engine housing 22. Specifically, as shown in FIG. 1A, flange 96 of sensor housing 92 includes arcuate slots 102 which allow fine rotational adjustment of sensor housing 92 with respect to spring housing 66. After such adjustment, fasteners 104 are tightened to fix the position of sensor housing 92 with respect to spring housing 66 and therefore, in turn, to fix the position of sensor housing 92 with respect to engine housing 22.

Cable 106 supplies an electric signal or voltage to one end of resistor 100 and a ground connection to another end of resistor 100. In the exemplary embodiment, the supplied signal is command signal 108 provided by operator control 46, as shown in FIG. 3. Wiper 110 is mounted on rotary shaft 62 at second end 74 thereof. Wiper 110 contacts resistor 100 and rotates relative to potentiometer disk 96 as rotary shaft 62 is rotated. Thus, resistor 100 and wiper 110 act as a variable voltage divider, with wiper 110 providing speed control signal 48 as a variable potential having a value between operator command signal 108 and ground, which varies according to the displacement of rotary shaft 62 and thus according to the speed of engine 20. Rotary sensor 68 receives second end 74 of rotary shaft 62 and detects the rotational displacement of rotary shaft 62. Based on the rotational displacement of rotary shaft 62, rotary sensor 68 outputs engine control signal 48 (FIG. 3) via cable 106.

Figure 3:
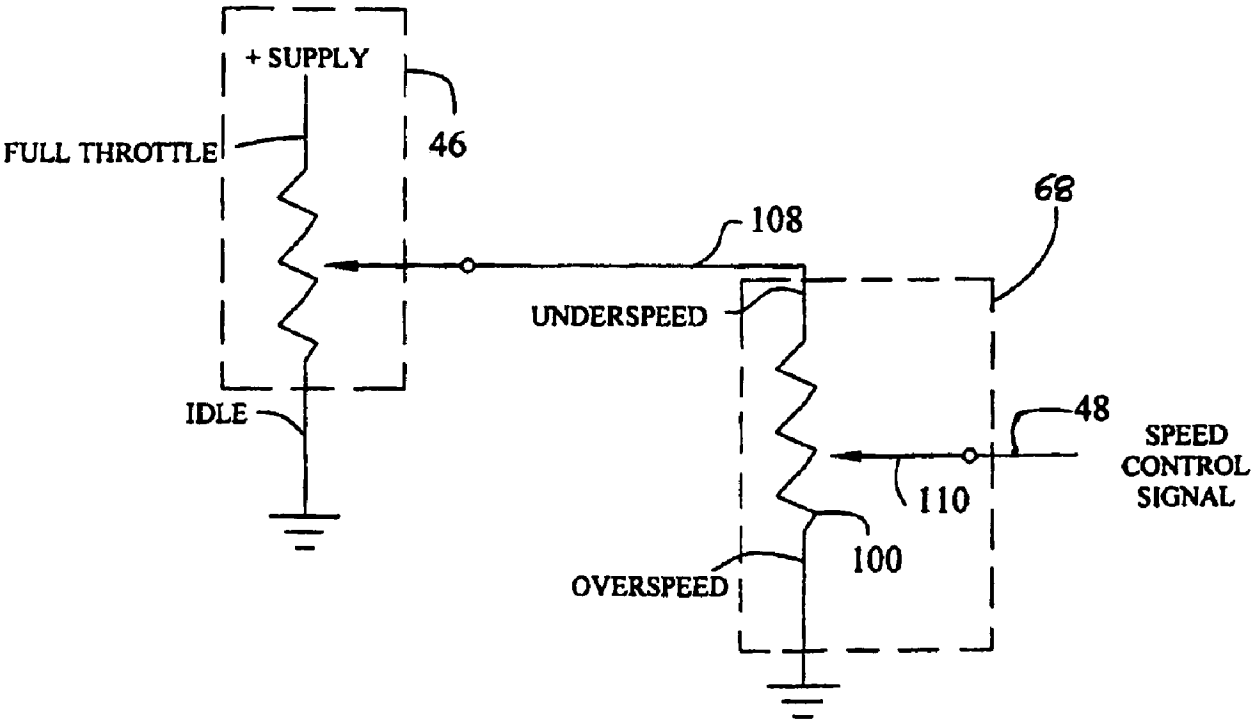
FIG. 3 is a schematic diagram of a portion of a first exemplary engine control system, according to the present invention.
Figure 4:
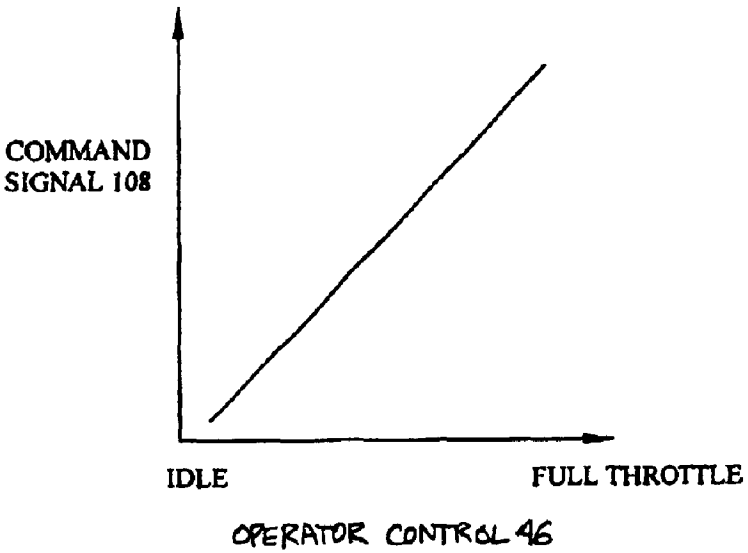
FIG. 4 is a graph illustrating the magnitude of the engine command signal in relation to adjustment of the operator control of the engine control system of FIG. 3.

Referring to FIG. 3, a partial schematic diagram for an exemplary control circuit for first exemplary engine control system 50 includes operator control 46 and rotary sensor 68. Both operator control 46 and rotary sensor 68 are implemented as potentiometers operating as linear voltage dividers. To provide engine speed command signal 108, operator control 46 is supplied with a voltage, such as a positive battery supply. Command signal 108 varies from a lower voltage for an idle or slow engine speed setting to a higher voltage for full throttle or a high speed engine setting, as shown graphically in FIG. 4.

Speed command signal 108 is provided to potentiometer 98 of rotary sensor 68. Rotary sensor 68 is driven by mechanical governor 34 such that speed control signal 48 output at wiper 110 is proportionally equal to or relatively close to command signal 108 for a low speed or under speed condition, and proportionally less than command signal 108 for a high or over speed engine condition, as shown graphically in FIG. 5. This arrangement provides for control of the engine speed under variable engine load conditions as the engine speed may tend to decrease or increase from the commanded speed with changing engine loading. Although command signal 108 is provided for controlling engine speed, modification of command signal 108 is modified by rotary sensor 68 to produce speed control signal 48; therefore, control signal 48 is a function of both commanded and actual engine speed. Alternatively, the output of rotary sensor 48 may supply operator control 46 and the output of operator control 46 providing control signal 48, also a function of both commanded and actual engine speed.

Figure 5:
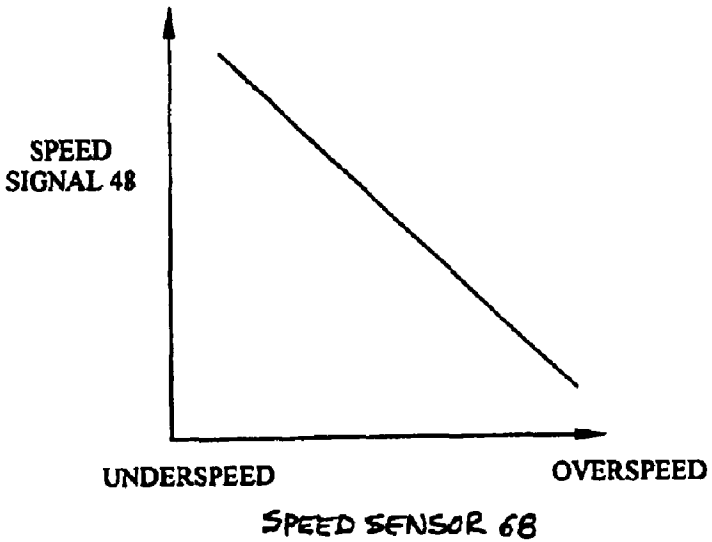
FIG. 5 is a graph illustrating the magnitude of the speed signal in relation to the engine speed sensed by the speed sensor of the engine control system of FIG. 3.
Figure 6A:
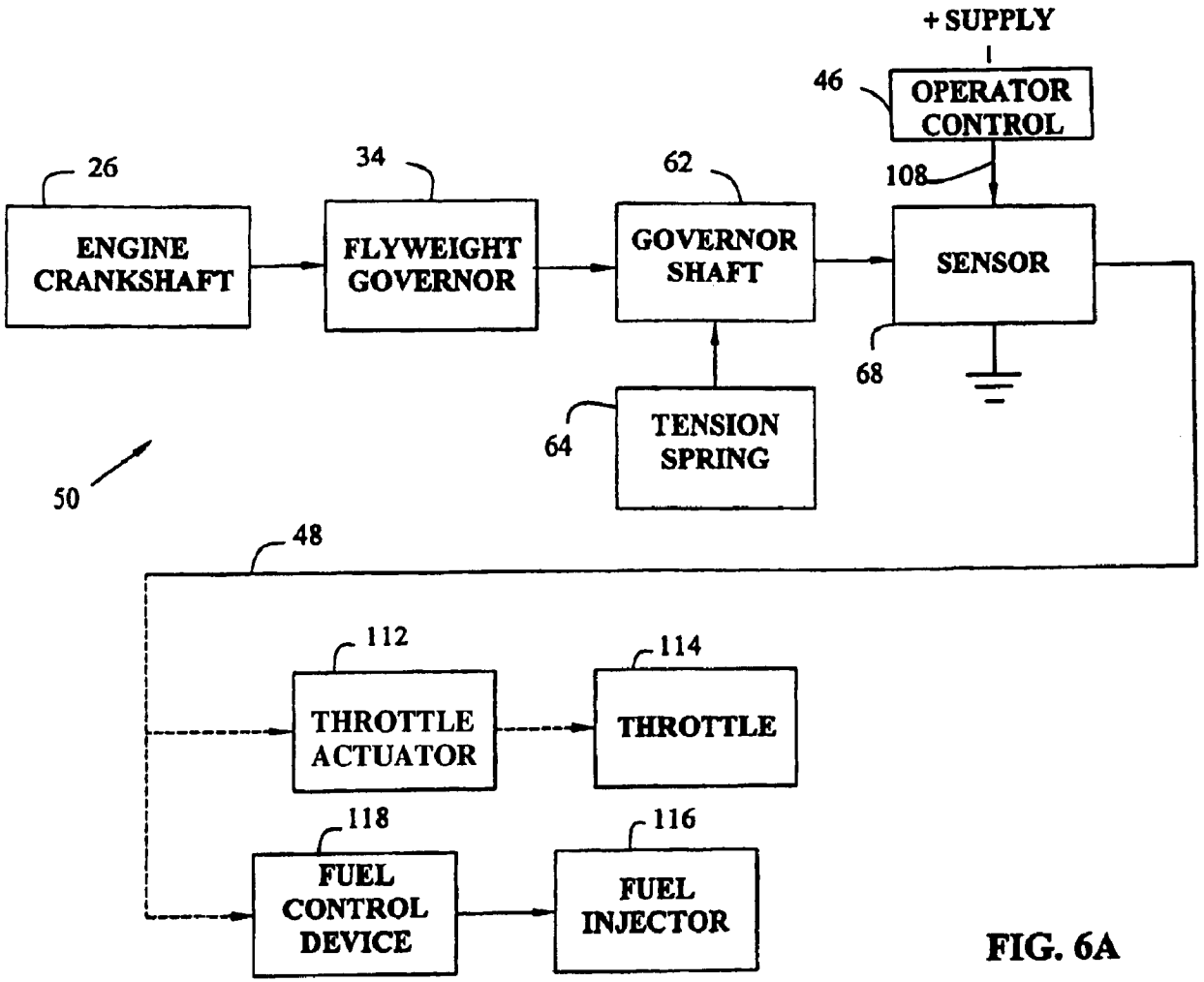
FIG. 6A is a block diagram schematically illustrating the first exemplary engine control system, a portion of which is shown in FIG. 3.

Referring to FIG. 6A, in first exemplary engine control system 50, speed control signal 48 is provided by voltage dividing command signal 108 according to the actual engine speed sensed by sensor 68. More particularly, engine crankshaft 26 drives flyweight governor 34 in accordance with the engine speed, as described above. Rotary governor shaft 62 couples flyweight governor 34 to sensor 68, and tension spring 64 is coupled with rotary shaft 62 so that displacement of rotary shaft 62 is normally biased to a lower resistance for sensor 68 for a lower engine speed, therefore minimizing the voltage adjustment to command signal 108 (FIG. 5). Sensor 68 detects the displacement of rotary shaft 62 and reduces command signal 108 as the engine speed increases, thereby providing speed control signal 48. Although sensor 68 in the exemplary embodiment is a potentiometer (FIG. 3) or other linear voltage device supplied by a command signal 108 and ground, other sensor devices, such as, for example, a rotary encoder or a linear variable resistor, may also be used in a similar or related control scheme.

Figure 10:
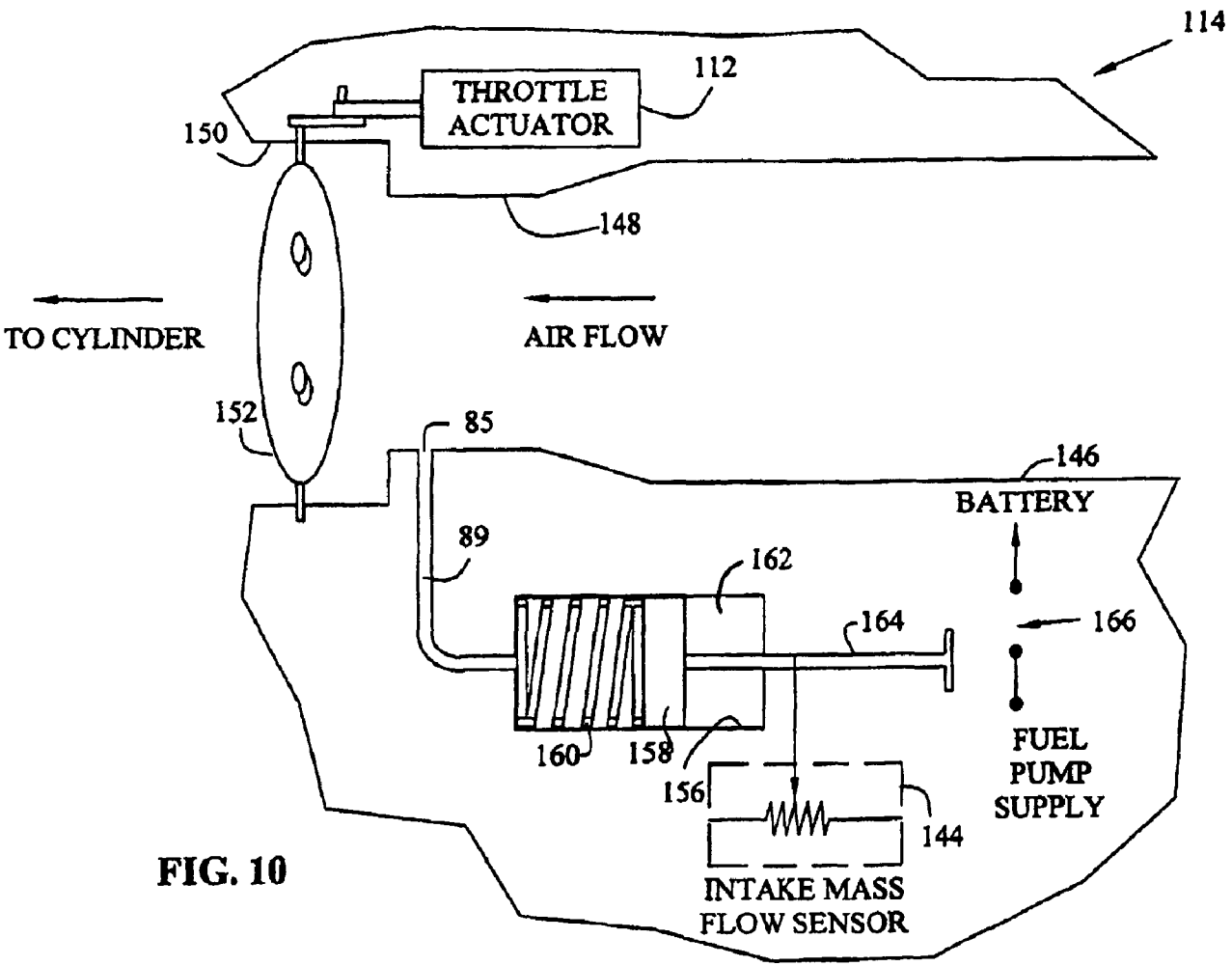
FIG. 10 is a sectional view of the throttle portion of the engine control system taken along lines 10—10 of FIG. 1A.

As shown in FIG. 6A, control signal 48 may be provided directly to throttle actuator 112 for controlling throttle 114 (FIGS. 1A and 6A). Throttle 114 may control both the fuel and air supplied to engine 20, and therefore the engine speed. Throttle actuator 112 moves throttle 114 by using a solenoid, transducer, or other electromechanical device, as shown in FIG. 10.

Engine control system 50 may also control an engine having fuel injector 116. Referring still to FIG. 6A, control signal 48 may be provided to fuel control device 118, which controls fuel flow to injector 116, in the same manner in which control signal 48 is provided to throttle actuator 112 as described above.

Figure 6B:
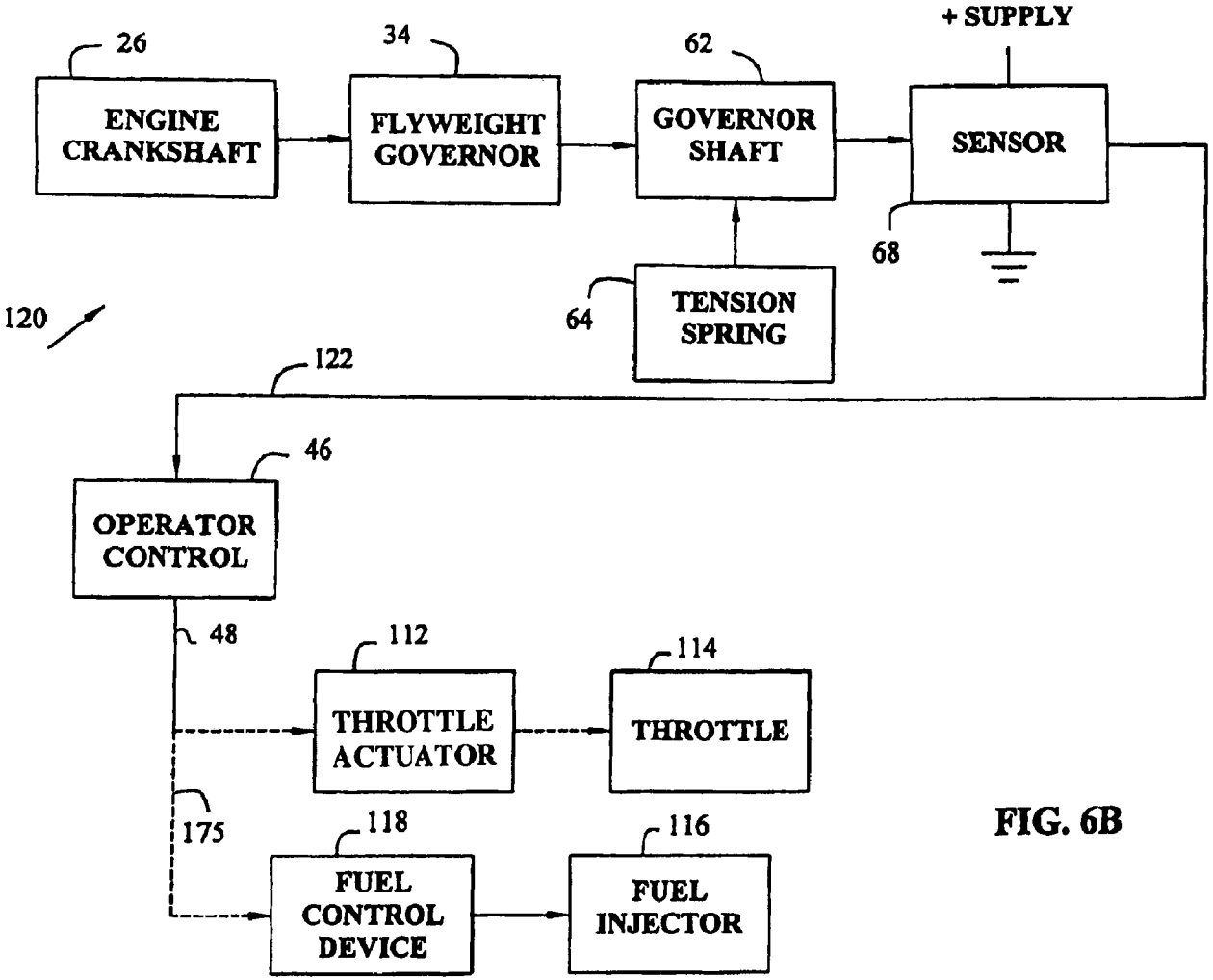
FIG. 6B is a block diagram schematically illustrating a second exemplary engine control system according to the present invention.

Second exemplary engine control system 120, shown in FIG. 6B, may include the same elements as first exemplary engine control system 50 shown in FIG. 6A. However, speed sensor 68 and operator control 46 are differently arranged in second exemplary engine control system 120. Specifically, speed sensor 68 receives a fixed voltage supply, for example, from a battery, and produces measured speed signal 122. Measured speed signal 122 is supplied to operator control 46. Operator control 46 provides speed control signal 48 to throttle actuator 112 and/or fuel control device 118.

Figure 7:
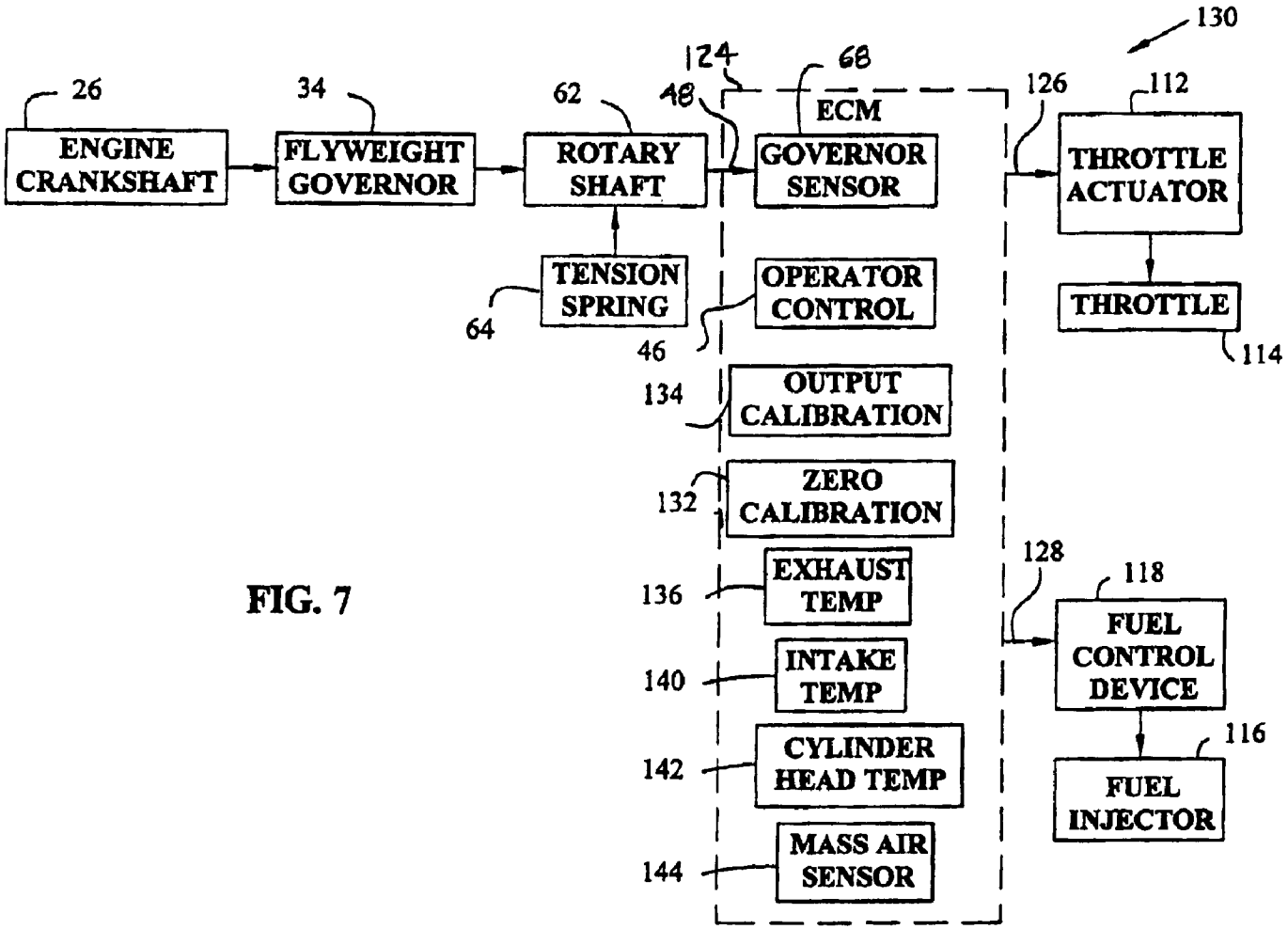
FIG. 7 is a block diagram schematically illustrating a third exemplary engine control system according to the present invention.

Third exemplary engine control system 130, shown in FIG. 7, may alternatively provide speed control signal 48 and command speed signal 108 separately to an engine control module (ECM) 124. ECM 124 may sum, compare, filter, or otherwise operate on the signals to provide throttle signal 126 to throttle actuator 112 and fuel control signal 128 to fuel control device 118.

Advantageously, flyweight governor 34 and sensor 68 of engine control systems 50, 120, 130 provide control signal 48 which may be related to actual and commanded engine speed, which may be used to control the intake system of an engine, and which may be easily electrically or electronically filtered, buffered, amplified, limited, or attenuated to better control the magnitude and oscillation of transient speed adjustments generally associated with known engine control systems which only include mechanical components. It is also advantageous in many applications related to small internal combustion engines to provide electrically transmitted signals, rather than signals transmitted by cables or other mechanical conduits.

Other linear operations adjusting the actual engine speed to the commanded engine speed, including increasing or decreasing the engine speed, filtering engine speed transients, and other control operations known in the art, may also be incorporated into engine control system 50, 120, and 130. For example, the outputs of operator control 46 and governor sensor 68 to adjust throttle signal 126 and fuel control signal 128, based on a fixed proportion determined by discrete analog circuit elements, or based on a stored schedule or function.

Figure 8A:
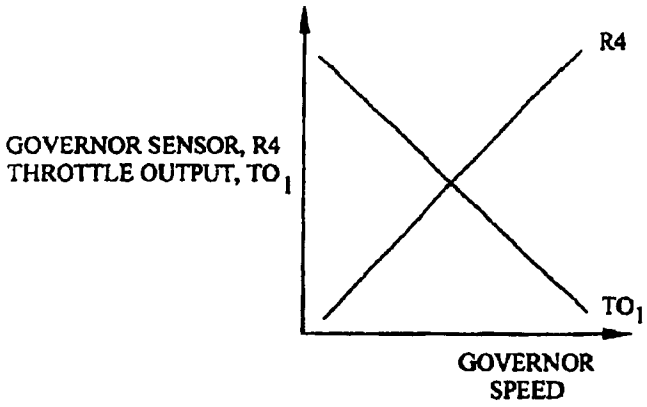
FIGS. 8A through 8E are graphs illustrating the relationship between various components and signals of the third exemplary engine control system shown in FIG. 7.

Third exemplary engine control system 130 may also include other sensors in order to provide for easy starting and optimum efficiency over a range of ambient and engine operating temperatures and conditions. Throttle control signal 126 is provided by adjusting the output of operator control 46 according to the actual engine speed sensed by governor sensor 68. Engine crankshaft 26 drives flyweight governor 34 in accordance with the engine speed, as described above for the first exemplary embodiment. Rotary governor shaft 62 couples flyweight governor 34 to sensor 68, and tension spring 64 is coupled with rotary shaft 62 so that displacement of rotary shaft 62 is normally biased to provide a higher signal output $TO_1$ from sensor 68 for a lower engine speed, as shown in FIG. 8A.

Figure 8C:
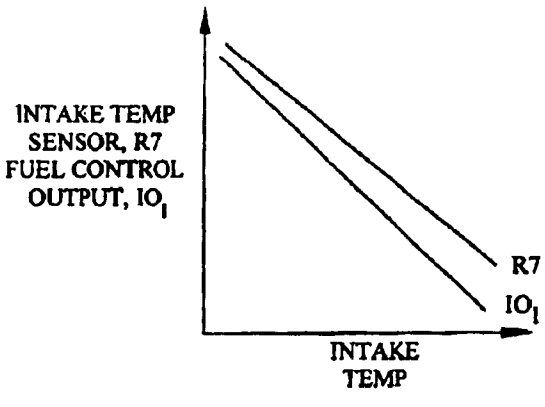
Figure 8B:
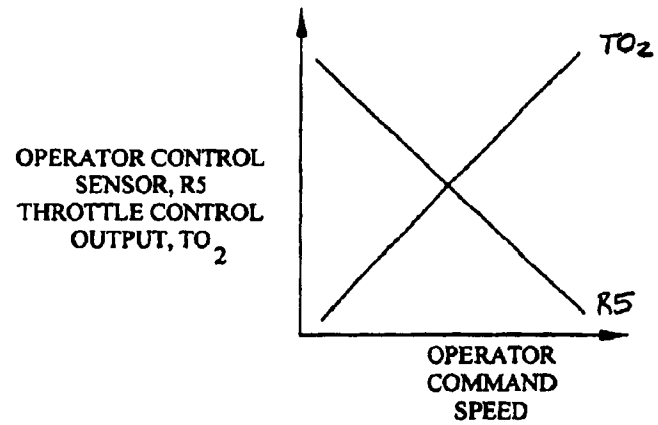

Operator control 46 provides an operator-commanded speed signal having a higher signal output $TO_2$ from operator control 46 for a higher commanded speed, as shown in FIG. 8B. Throttle signal 126 is determined by ECM 124 as a function of $TO_1$ and $TO_2$. Zero calibration 132 (FIG. 7) is provided for adjusting the minimum voltage or current of throttle control signal 126 and/or fuel control signal 128 at the lowest operator command speed setting. Output calibration 134 is provided for adjusting the voltage or current span of throttle control signal 126 and/or fuel control signal 128.

As shown in FIG. 7, governor sensor 68, operator control 46, output calibration 134, and zero calibration 132 may all be used to determine throttle control signal 126 for controlling throttle actuator 112, which in turn mechanically drives throttle 114, and to determine fuel control signal 128 for controlling fuel control device 118, which in turn determines the fuel flow through fuel injector 116. For example, if governor sensor 68 senses an over-speed condition, throttle control signal 126 will be reduced by governor sensor 126 proportional to the over-speed, thus reducing throttle control signal 126 and adjusting throttle 114 to slow the engine speed. Such an over-speed condition may be more likely when the operator-commanded speed is high and the engine is exposed to a low or reduced load. In the case of a heavily loaded engine 20, it is likely that the engine speed will be limited by the load and that governor sensor 68 will not act to reduce throttle control signal 126 to close throttle 114.

Third exemplary engine control system 130 also provides engine control in response to ambient and engine operating conditions. Specifically, exhaust temperature sensor 136, shown mounted in exhaust passage 40, which is coupled to muffler 138 in FIG. 1B, senses the engine gas exhaust temperatures flowing from engine 20. Intake temperature sensor 140, shown mounted in intake passage 38 in FIG. 1B, provides sensing of ambient air drawn into engine 20 and also of engine cylinder head 36 operating temperature. Thus, as shown in FIG. 7, exhaust gas temperature sensed by sensor 136 and intake and cylinder head temperature sensed by intake sensor 140 may be used to determine fuel control signal 128 for controlling fuel control device 118. Output calibration 134 or a separate output calibration for fuel control may also provide voltage and current scaling to set the maximum fuel control signal 128. Similarly, zero calibration 132 or a separate zero calibration device may provide the minimum setting for fuel control signal 128.

Additional sensors used to determine throttle control signal 126 and/or fuel control signal 128 may also be included and coupled to ECM 124, for example, mass air sensor 144 and cylinder head temperature sensor 142.

In the case of starting a cold engine in cold conditions, it is desirable to provide a rich fuel-to-air mixture, and thus a higher fuel control signal 128 for increased fuel flow. Therefore, as shown in FIG. 8C, at a low intake temperature a high signal $IO_1$, is provided for fuel control signal 128.

Figure 8D:
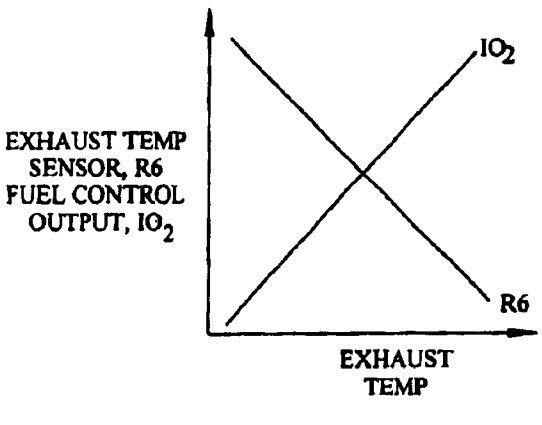

As exhaust gas temperatures are directly related to a rich or lean mixture, as shown in FIG. 8D, as the exhaust temperature increases signal $IO_2$ is provided to increase fuel control signal 128, thus enriching the mixture and reducing the engine operating temperature for cooler engine operation. Fuel control signal 128 may be a function of signals $IO_1$ and $IO_2$.

Depending on the implementing circuit configuration, the output of intake temperature sensor 140 may inversely relate to intake temperature, and the output of exhaust temperature sensor 136 may proportionally relate to exhaust temperature, as shown in FIGS. 8C and 8D.

In order to limit the leaning effect that exhaust temperature sensor 136 would have during a cold-start operating condition, exhaust temperature sensor 136 may be disabled under cold-start conditions, such as by intake temperature sensor 140 sensing a temperature below a preset level.

Intake mass airflow sensor 144 may be implemented, for example, as shown in FIG. 10. Throttle 114 includes intake opening 146, narrowing venturi 148, and intake pipe connection 150. As throttle actuator 112 adjusts throttle plate 152, thereby restricting the airflow through throttle 114, the pressure differential generated at narrowing venturi 148 varies proportionally with the mass airflow into engine 20. Throttle actuator 112 may be biased by an internal spring to a position that closes throttle plate 152, thereby restricting airflow into the cylinder of engine 20. Venturi tube 154 conducts vacuum to cylinder 156, in which piston 158 translates against spring 160 in accordance with a differential between ambient air pressure 162 and the lower pressure present in venturi tube 89. As piston 158 translates, connecting member 164 actuates intake mass airflow sensor 144 and fuel pump cutoff switch 166, which supplies power to fuel pump 168 (FIG. 9).

Intake mass airflow sensor 144 may be a variable resistor, such as a potentiometer, that is mechanically driven by connecting member 164. Alternatively, intake mass airflow sensor 144 may be another sensor type capable of measuring pressure or the displacement of connecting member 164. Thus, intake mass airflow sensor 144 provides a variable voltage or current signal proportional to the mass airflow through throttle 114. Additionally, fuel pump cutoff switch 166 provides a safety shutoff for fuel pump 168 when insufficient airflow is present through throttle 114, i.e., engine 20 is not running or drawing air through throttle 114.

Figure 8E:
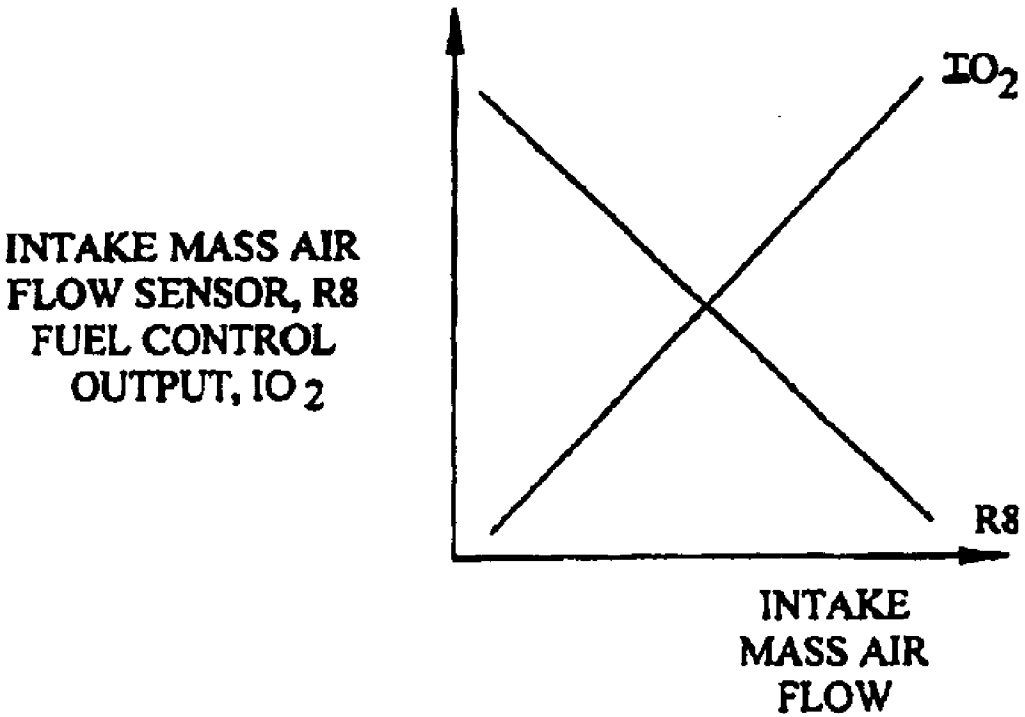

Referring to FIG. 8E, as the intake mass airflow increases, requiring additional fuel to maintain an optimum fuel-to-air mixtures, signal 102 increases, thus increasing fuel control output signal 128 to fuel injector 282.

Figure 9:
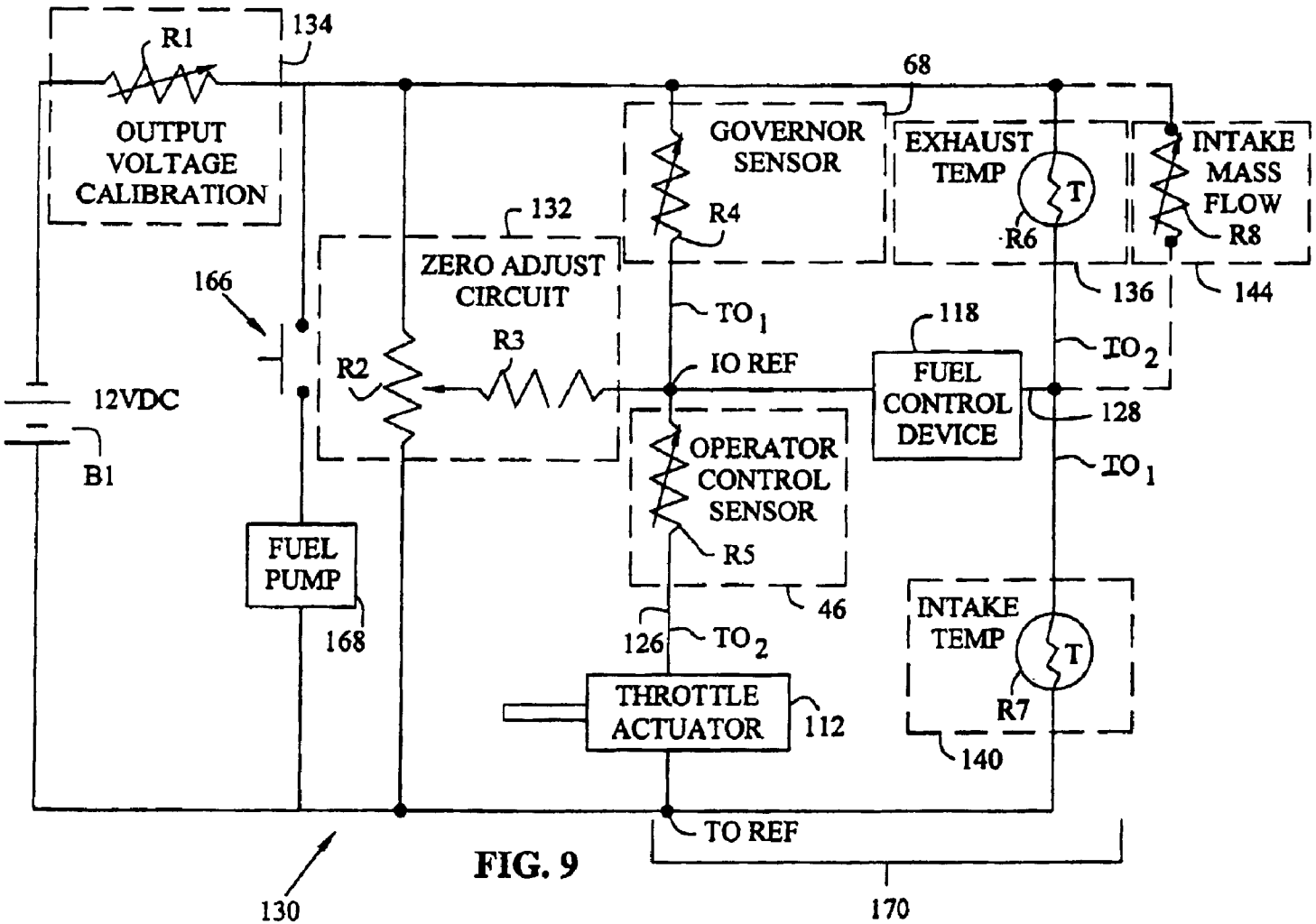
FIG. 9 is a schematic diagram of the third exemplary engine control system of FIG. 7.

Referring to FIG. 9, an exemplary circuit implementing third exemplary engine control system 130 is shown. Engine control system 130 may also be implemented by other circuit configurations, including analog, digital, and microprocessor based circuits. Power to engine control system 130 may be provided by a 12 volt D.C. power source, such as battery B1. Output calibration 134 may be provided by variable resistor R1 that operates with voltage dividing resistor R2 to adjust the voltage supplied to sensor bridge network 170. Output voltage calibration 134 is provided to adjust the maximum voltage output to throttle actuator 112 and fuel control device 118 at the highest operator command speed setting. Variable resistor R2 is coupled between the output of variable resistor R1 and ground and, along with fixed resistor R3, provides zero adjust circuit 132 for adjusting the minimum voltage provided to throttle actuator 112 and fuel control device 118 at a minimum operator control speed setting.

The output signal of variable resistor R1 is provided to variable resistor R4, which is coupled in series with variable resistor R5 and throttle actuator 112. Rotary governor sensor 68 comprises variable resistor R4 and, as shown in FIG. 8A, has an increased resistance with increased governor speed, therefore reducing throttle control signal $TO_1$, provided to variable resistor R5. Operator control sensor 46 comprises variable resistor R5 and, as shown in FIG. 8B, has a lower resistance value at increased operator-commanded speeds, thereby providing an increased throttle control output signal $TO_2$ at higher-commanded speeds.

Exhaust temperature sensor 136 comprises thermistor R6, or a similar temperature-sensing device, such as a resistance temperature detector (RTD). Intake mass airflow sensor 144 comprises variable resistor R8. Third exemplary engine control system 130 includes only one of exhaust temperature sensor 136 and intake mass airflow sensor 144. Intake temperature sensor 140 comprises thermistor R7, or a similar temperature-sensing device such as an RTD.

Either exhaust temperature sensing device 136 or intake mass airflow sensor 144 and intake temperature sensor 140 are coupled in series between variable resistor R1 and battery B1 ground. Fuel control device 118 is coupled to the node between the two sensors. The signal reference $IO_{ref}$ for fuel control device 118 may be coupled to resistor R3 of zero adjust circuit 132, or to another node in engine control system 130, for example, battery B1 ground.

As shown in FIG. 8C, as intake temperature increases, the resistance value of thermistor R7 decreases, thus reducing signal $IO_1$ and fuel control signal 128 as intake temperature increases. As shown in FIG. 8D, the resistance value of thermistor R6 decreases as exhaust temperature increases, thus increasing signal $IO_2$ and fuel control signal 128 as exhaust temperature increases. Alternatively, if engine control system 130 includes variable resistor R8 of intake mass airflow sensor 144, as the intake mass airflow increases, the resistance of variable resistor R8 decreases, thus increasing signal $IO_2$ and fuel control signal 128 as intake mass airflow increases.

Figure 11:
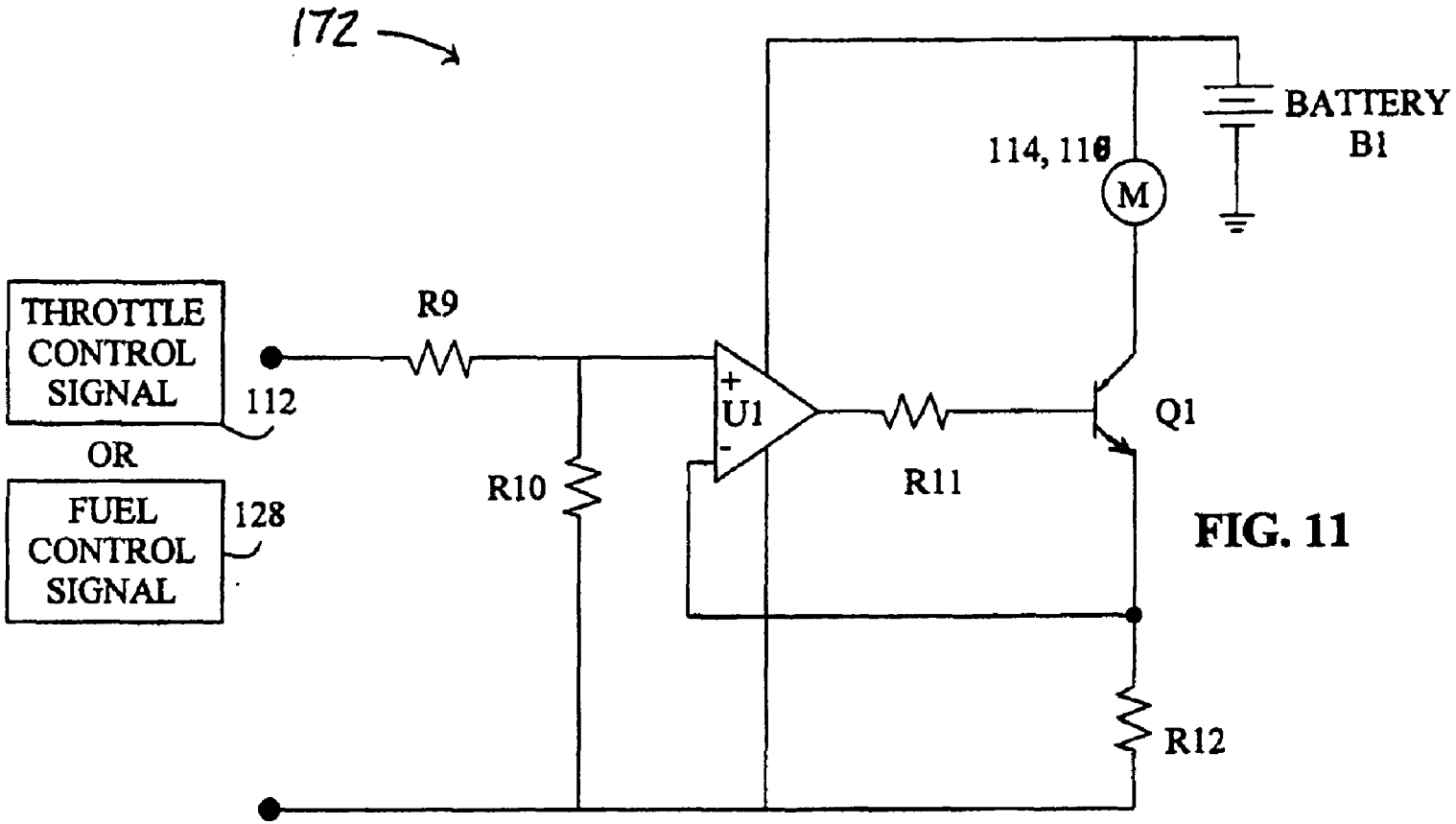
FIG. 11 is a schematic diagram of an exemplary fuel controller of the engine control system.

Referring to FIG. 11, exemplary fuel controller voltage to current amplifier 172 is shown. Amplifier 172, or another such exemplary power amplifying circuit known in the art provides linear driving of DC motors, solenoids, and the like. For third exemplary embodiment control system 130, amplifiers 172 may be used for linear driving of throttle actuator 112 and fuel control device 118. Specifically, throttle control signal 112 and fuel control signal 128 may be provided at the resistor R9 input to each of two amplifiers 172. The arrangement of circuit elements in amplifier 172, exemplary values of which are listed in Table 1, provide linear voltage to current transfer to drive throttle actuator 112 or fuel control device 118. Specifically, resistor R12 senses the current output of amplifier 172 so that the output current is linear to the input voltage at resistor R9.

Figure 12:
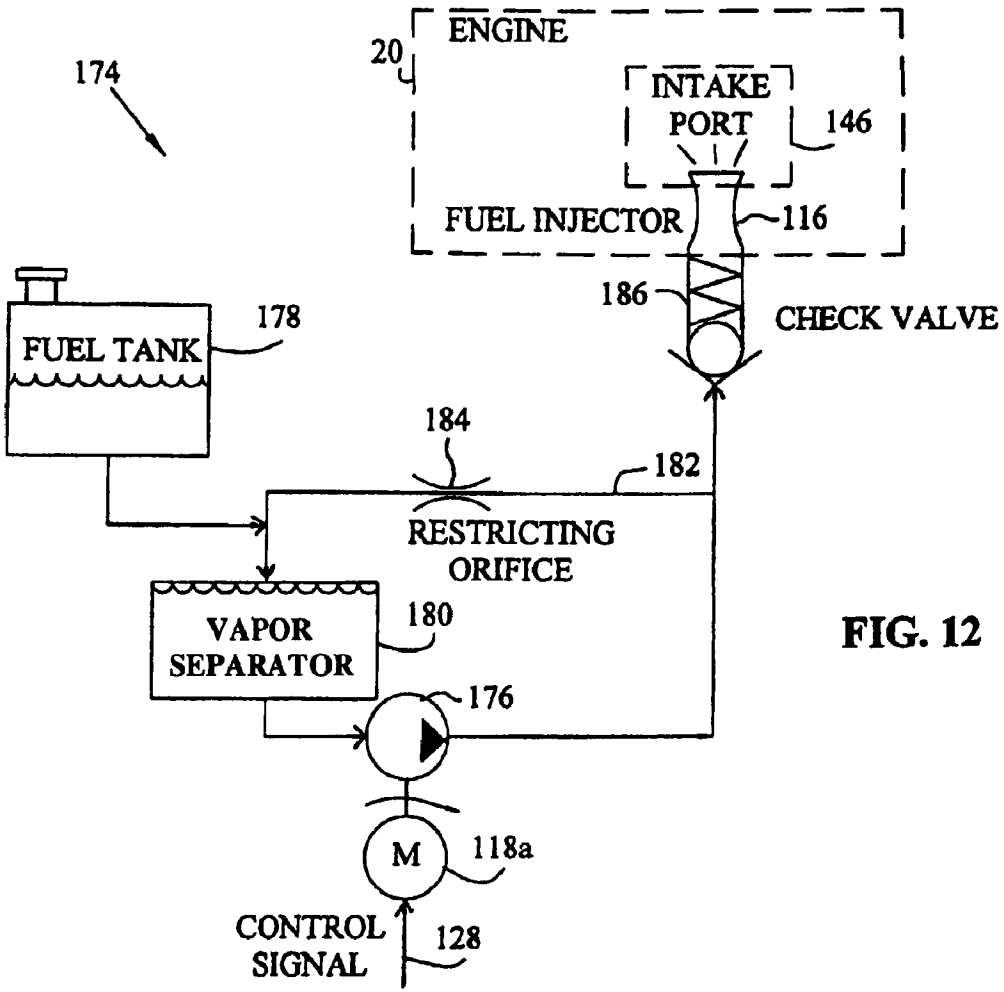
FIG. 12 is a first exemplary fuel system of the engine control system.

FIG. 12 shows first exemplary fuel system 174 which provides fuel flow control and may be included with any of engine control systems 50, 120, and 130. Fuel system 174 includes fuel pump 176 for pumping fuel from fuel tank 178 through fuel injector 116 and into intake port opening 146 of engine 20. Fuel pump 176 draws fuel from fuel tank 178 through vapor separator tank 180. Vapor separator tank 180 provides a trap to remove fuel vapors that may be generated in fuel system 174 under elevated operating temperatures. Return fuel line 182 includes restricting orifice 184 and provides a fuel flow path between the junction of the output of pump 176 and fuel injector 116 and the junction of fuel tank 178 and vapor separator 180. Check valve 186 is coupled between the output of pump 176 and fuel injector 116. When pump 176 is stopped, check valve 186 prevents fuel from entering intake port 146 and prevents air from intake port 176 from entering fuel system 174.

The fuel pressure, and therefore the fuel flow, at fuel injector 116 is controlled by a combination of the flow restriction provided by restricting orifice 182 and the fuel pressure created by fuel pump 176. To control the resulting fuel flow through fuel injector 116, fuel pump 176 is driven by variable speed motor 118*a*, which serves as the fuel control device discussed above. Thus, variable speed motor 118*a* may be driven by fuel control signal 128 in order to provide a desired fuel flow to engine 20. By adjusting the range of fuel control signal 128, for example, by adjusting output calibration 134 and zero calibration 132 in third exemplary engine control system 130, the fuel pressure can be controlled between 0 psi and a value approaching the deadhead pressure of pump 176.

Figure 13:
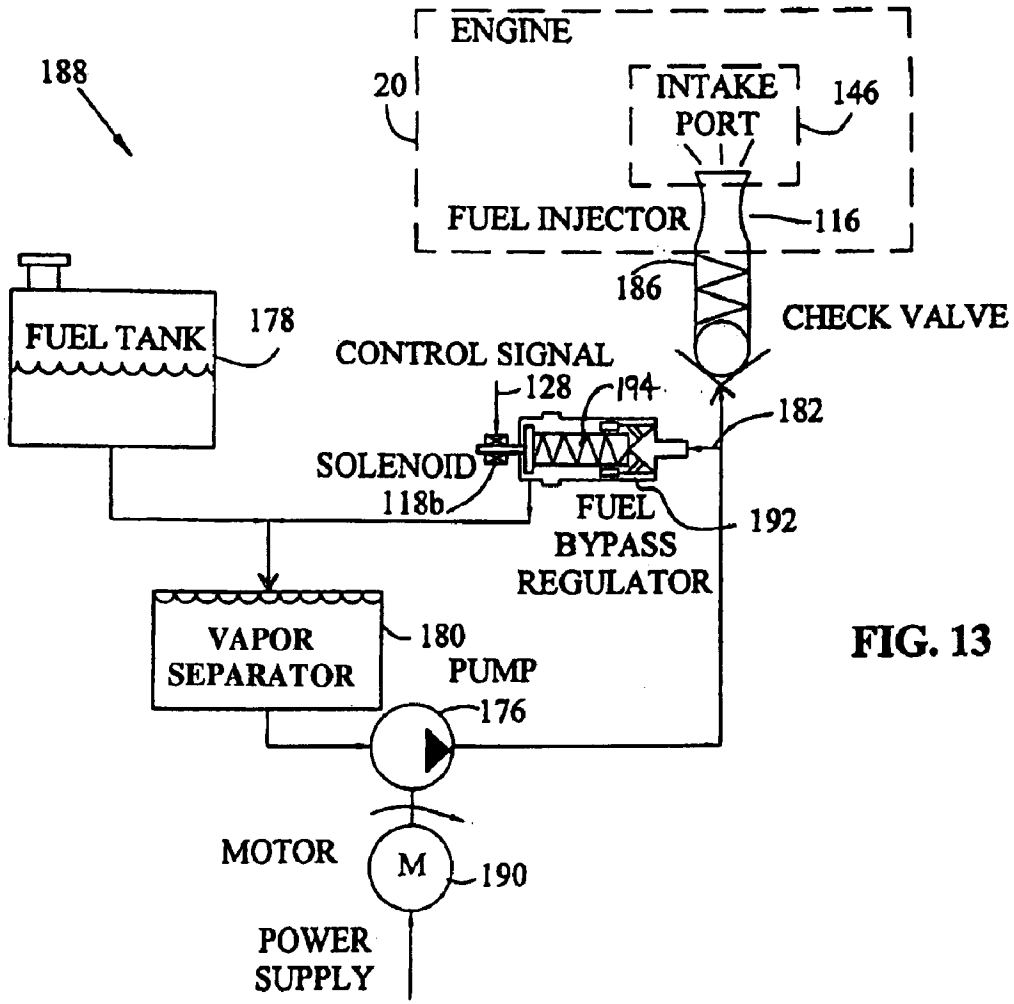
FIG. 13 is a second exemplary fuel system of the engine control system.

FIG. 13 shows second exemplary fuel system 188 which controls fuel flow through fuel injector 116 into intake port 146 of engine 20 and may be used with any of exemplary engine control systems 50, 120, and 130. Fuel system 188 includes fuel pump 176 which is driven by single speed electric motor 190 and pumps fuel from fuel tank 178 through fuel injector 116. Similar to first exemplary fuel system 174, second exemplary fuel system 188 also includes fuel separator 180 between fuel tank 178 and pump 176 and check valve 186 prevents return of fuel through return fuel line 182 and fuel injector 116 when fuel pump 176 is stopped.

The fuel pressure for second exemplary fuel system 188 and therefore the fuel flow through fuel injector 116 is determined by the constant speed of and therefore fuel flow through fuel pump 176 and the variable fuel flow through return line 182, which is controlled by fuel bypass regulator 192. To achieve a constant fuel flow at pump 176, motor 190 is driven by a fixed power source, such as battery B1. To control the return line 182 flow and therefore the fuel flow through fuel injector 116, fuel bypass regulator 192 is actuated by solenoid 118*b*. Solenoid 118*b* may be driven by fuel control signal 128. Solenoid 118*b* and fuel bypass regulator 192 provide the fuel control device discussed above and provide linear fuel flow control of fuel system 188.

Fuel bypass regulator 192, which may be, for example, a device such as the one disclosed by U.S. patent application Ser. No. 10/641,556, entitled "Bypass Pressure Regulator," by Rado, filed Aug. 15, 2003, the assignee of which is the assignee of the present application, the disclosure of which is hereby incorporated herein. While the referenced disclosed bypass regulator includes a valve and spring to provide fuel flow when the fuel pressure exceeds a certain preset level, fuel bypass regulator 192 provides a variable fuel flow and therefore a variable fuel pressure by adding linear solenoid 118*b* which adjusts the pressure that spring 194 applies to valve shuttle 196 of regulator 192. The inventive arrangement of fuel bypass regulator 192 and solenoid 118*b* allows fuel control signal 128 to regulate the fuel flow through fuel return line 182, thereby providing for linear control of fuel flow through fuel injector 116.

TABLE 1

| Component Label | Value |
|---|---|
| R9 | 4900 |
| R10 | 100 |
| R11 | 500 |
| R12 | 0.1 |
| U1 | LF358NS |
| Q1 | BD135/PLP |

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An engine control system for a small internal combustion engine, comprising:

a governor assembly mounted to and driven by the engine and responsive to engine speed;

a coupling member associated with said governor assembly, said coupling member displaceable by said governor assembly according to engine speed; and a position sensor associated with said coupling member, said position sensor detecting the displacement of said coupling member and outputting an electrical speed signal corresponding to the displacement of said coupling member and to engine speed.

2. The engine control system of claim 1, wherein said coupling member includes a rotary shaft rotationally displaceable by said governor assembly.

3. The engine control system of claim 2, wherein said position sensor includes a rotary sensor.

4. The engine control system of claim 2, wherein said position sensor includes a potentiometer.

5. The engine control system of claim 2, wherein:

said governor assembly includes a spool and at least one flyweight, said at least one flyweight capable of translating said spool laterally according to the engine speed; and said rotary shaft includes a radially extending lever adjacent one end of said rotary shaft and contacting an end of said spool, wherein lateral movement of said spool rotationally displaces said rotary shaft.

6. The engine control system of claim 2, further comprising a spring coupled between said engine and said rotary shaft, said spring biasing said rotary shaft against said rotational displacement.

7. The engine control system of claim 1, further comprising:

an operator engine control producing an electrical command signal; and a control circuit capable of determining an engine speed control signal based on said command signal and said speed signal.

8. The engine control system of claim 7, wherein said control circuit determines said engine speed control signal as a portion of said command signal, said portion based on actual engine speed sensed by said position sensor.

9. The engine control system of claim 8, wherein said position sensor includes a potentiometer having an input and a variable output, said command signal being coupled to said input and said engine speed control signal is provided by said variable output.

10. The engine control system of claim 7, wherein said engine speed control signal is the sum of said command signal and said speed signal.

11. The engine control system of claim 7, further comprising a fuel control device receiving said engine speed control signal.

12. The engine control system of claim 7, further comprising an electromechanical throttle actuator receiving said engine control signal.

13. The engine control system of claim 12, further comprising a fuel control device, and wherein said control circuit further comprises:

at least one of an intake air sensor and an exhaust gas temperature sensor; and a fuel control signal determined as a function of the output of said at least one of said intake air sensor and said exhaust gas temperature sensor, said fuel injector control signal controlling said fuel control device.

14. The engine control system of claim 13, wherein said intake air sensor senses at least one of intake air temperature, cylinder head temperature, and intake mass airflow.

15. An internal combustion engine, comprising:

an engine housing;

at least one of a throttle and a fuel control device connected to said housing;

a governor assembly connected to said housing and responsive to engine speed; a coupling member coupled to said governor assembly and movably displaced by said governor assembly in response to engine speed; and a position sensor mounted to said housing and adapted for detecting the position of said coupling member and outputting an electrical speed signal, said speed signal acting upon at least one of said throttle and said fuel control device to adjust the engine speed.

16. The internal combustion engine of claim 15, wherein said coupling member is rotationally displaced by said governor assembly in response to the engine speed and said position sensor is a rotary position sensor.

17. The internal combustion engine of claim 16, further comprising a spring biasing said rotary shaft against said rotational displacement.

18. The internal combustion engine of claim 15, further comprising:

at least one of an intake temperature sensor and an exhaust gas temperature sensor; and a fuel control signal determined as a function of the output of said at least one of said fuel intake air sensor and said exhaust gas temperature sensor, said fuel control signal controlling said fuel control device.

19. The internal combustion engine of claim 18, wherein said intake air sensor senses at least one of intake air temperature, cylinder head temperature, and intake mass airflow sensor.

20. An engine control system for a small internal combustion engine, comprising:

a governor assembly driven by the engine, said governor assembly including a spool capable of translating axially in response to the engine speed;

a rotary shaft associated with said spool such that said rotary shaft is rotationally displaced upon translation of said spool;

a spring coupled between the engine and said rotary shaft, said spring resisting rotational displacement of said rotary shaft; and a rotary position sensor capable of detecting the rotational position of said rotary shaft and outputting an electrical speed signal corresponding to the rotational position.

21. The engine control system of claim 20, further comprising an operator engine control capable of producing an electrical command signal, and an engine speed control signal determined as a function of said command signal and said speed signal, said engine speed control signal supplied to at least one of a fuel control device and an electromechanical throttle actuator.

22. The engine control mechanism of claim 21, further comprising at least one of an intake sensor and an exhaust gas temperature sensor, and a fuel control signal determined as a function of the output of said at least one of said intake sensor and said exhaust gas temperature sensor outputs.

23. A method of controlling the speed of an internal combustion engine having a mechanical governor, throttle, and fuel injector, comprising the steps of:

supplying a commanded engine speed signal;

driving the governor to produce an output proportional to engine speed;

sensing the governor output;

producing an actual engine speed signal from the governor output; and controlling the throttle based on the actual engine speed signal and the commanded engine speed signal.

24. The method of claim 23, comprising the further steps of:

sensing the intake temperature;

sensing at least one of the exhaust gas temperature and the intake mass airflow; and controlling fuel flow through the fuel injector based on the intake temperature and the at least one of the exhaust gas temperature and the intake mass airflow.

25. The method of claim 23, comprising the further steps of:

sensing at least one of the intake air temperature and intake mass airflow;

sensing the engine cylinder head temperature; and controlling fuel flow through the fuel injector based on the engine cylinder head temperature and the at least one of the intake air temperature and intake mass airflow.

26. An engine control circuit in an internal combustion engine including a mechanical speed sensing governor, the circuit comprising:

at least one of a voltage supply and a current supply;

a governor sensor coupled to said governor and having an input and an output, said governor sensor input coupled to said at least one of a voltage supply and current supply;

an operator control sensor having an input and an output, said operator control sensor input coupled to said governor sensor output; and at least one of an intake throttle actuator and a fuel control device coupled to said operator control sensor output.

27. The engine control circuit of claim 26, further comprising:

an exhaust gas temperature sensor having an input and an output, said exhaust gas temperature sensor input coupled to said at least one of a voltage supply and a current supply; an intake temperature sensor having an input and an output, said intake temperature sensor input coupled to said at least one of a voltage supply and a current supply; and a fuel control device having an input coupled to said exhaust gas temperature sensor output and to said intake temperature sensor output.

28. The engine control circuit of claim 26, further comprising:

an intake airflow sensor having an input and an output, said intake airflow sensor input coupled to said at least one of a voltage supply and a current supply;

an intake temperature sensor having an input and an output, said intake temperature input coupled to said at least one of a voltage supply and a current supply; and a fuel control device having an input coupled to said intake airflow sensor output and to said intake temperature sensor output.

29. An engine control circuit in an internal combustion engine including a mechanical speed sensing governor, the circuit comprising:

at least one of a voltage supply and a current supply;

an operator control sensor having an input and an output, said operator control sensor input coupled with said at least one of a voltage supply and a current supply;

a governor sensor coupled to said governor and having an input and an output, said governor sensor input coupled to said operator control sensor output; and at least one of an intake throttle actuator and a fuel control device coupled to said governor sensor output.

30. The engine control circuit of claim 29, further comprising:

an exhaust gas temperature sensor having an input and an output, said exhaust gas temperature sensor input coupled to said at least one of a voltage supply and a current supply;

an intake temperature sensor having an input and an output, said intake temperature sensor input coupled to said at least one of a voltage supply and a current supply; and a fuel control device having an input coupled to said exhaust gas temperature sensor output and to said intake temperature sensor output.

31. The engine control circuit of claim 29, further comprising:

an intake airflow sensor having an input and an output, said intake airflow sensor input coupled to said at least one of a voltage supply and a current supply;

an intake temperature sensor having an input and an output, said intake temperature input coupled to said at least one of a voltage supply and a current supply; and a fuel control device having an input coupled to said intake airflow sensor output and to said intake temperature sensor output.

32. An engine control system in an internal combustion engine including a mechanical speed sensing governor, the system comprising:

an operator control sensor providing a command signal proportional to the desired engine speed;

an engine speed sensor coupled to said governor and providing a speed signal proportional to the actual engine speed;

a control circuit receiving said command signal and said speed signal and providing a fuel control signal determined as a function of said command signal and said speed signal; and a fuel control device having an actuator adapted for adjusting the fuel flow through said fuel control device, said actuator receiving said fuel control signal.

33. The engine control system of claim 32, further comprising:

a governor assembly mounted to and driven by the engine, said governor assembly responsive to the engine speed; and a coupling member associated with said governor assembly, said coupling member displaced flow by said governor assembly according to the engine speed;

wherein said engine speed sensor senses the displacement of said coupling member.

34. The engine control system of claim 33, wherein said fuel control device comprises a variable speed fuel pump motor, said pump motor driven by said fuel control signal.

35. The engine control system of claim 33, wherein said fuel control device comprises a solenoid controlled variable fuel pressure regulator, said solenoid driven by said fuel control signal.

36. The engine control system of claim 35, further comprising a fuel system including a fuel source tank and a fuel pump driven by a fixed speed motor, and wherein said fuel pressure regulator is coupled in parallel with said fuel pump, thereby returning a variable fuel flow to said fuel source tank.

37. The engine control system of claim 34, further comprising a fuel system including a fuel pump driven by said variable speed fuel pump and a fixed restricting orifice coupled in parallel with said fuel pump.

* * * * *